US012716349B2

(12) United States Patent
Lu et al.

(10) Patent No.: US 12,716,349 B2
(45) Date of Patent: Aug. 25, 2026

(54) SYSTEMS AND METHODS FOR WELLBORE DRILLING UTILIZING A THERMOCHEMICAL SULFATE REDUCTION (TSR) PROXY

(71) Applicant: Saudi Arabian Oil Company, Dhahran (SA)

(72) Inventors: Peng Lu, Dhahran (SA); Pan Luo, Dhahran (SA); Wei Wei, Beijing (CN)

(73) Assignee: Saudi Arabian Oil Company, Dhahran (SA)

( * ) Notice: Subject to any disclaimer, the term of this patent is extended or adjusted under 35 U.S.C. 154(b) by 532 days.

(21) Appl. No.: 18/344,384

(22) Filed: Jun. 29, 2023

(65) Prior Publication Data

US 2024/0068355 A1 Feb. 29, 2024

Related U.S. Application Data

(63) Continuation of application No. PCT/CN2022/115818, filed on Aug. 30, 2022.

(51) Int. Cl.
*E21B 47/00* (2012.01)
*E21B 21/06* (2006.01)
(Continued)

(52) U.S. Cl.
CPC ..... *E21B 47/006* (2020.05); *E21B 21/062* (2013.01); *E21B 21/068* (2013.01);
(Continued)

(58) Field of Classification Search
CPC ..... E21B 41/02; E21B 21/062; E21B 43/27; E21B 21/08; E21B 47/006; E21B 21/068;
(Continued)

(56) References Cited

U.S. PATENT DOCUMENTS 11,525,935 B1 * 12/2022 Camargo ..... G01V 1/30
11,753,926 B2 * 9/2023 Mishkhes ..... E21B 47/08 166/250.05
(Continued)

FOREIGN PATENT DOCUMENTS

CN 105403929 A 3/2016
CN 105473816 A 4/2016
(Continued)

OTHER PUBLICATIONS

Bryndzia et al., "Predicting the Concentration of Hydrogen Sulfide in Hydrocarbon-Bearing Clastic Reservoirs: Introducing the Iron-Chlorite-Pyrite-Hydrogen Sufide Model", Society of Petroleum Engineers, 2020 SPE Journal, SPE201190, Feb. 17, 2020.
(Continued)

*Primary Examiner* — An H Do
(74) *Attorney, Agent, or Firm* — Dinsmore & Shohl LLP

(57) ABSTRACT

This disclosure relates to systems for wellbore drilling and methods for preparing wellbore drilling fluid. The system can include a drilling fluid tank that holds wellbore drilling fluid for introduction into a wellbore, an additive distribution component fluidly coupled to the drilling fluid tank that holds a first additive, and a computing device communicatively coupled to the additive distribution component. The methods can include a computing device performing at least the following: receiving drilling parameters that identify wellbore drilling conditions of a wellbore drilling system, calculating a thermochemical sulfate reduction (TSR) proxy value of the wellbore. In response to determining that a predicted hydrogen sulfide concentration meets a predetermined threshold, the computing device can determine a first quantity of a first additive to be added to the wellbore drilling fluid and combine the first quantity of the first additive with the wellbore drilling fluid.

19 Claims, 4 Drawing Sheets

(51) Int. Cl.
*E21B 21/08* (2006.01)
*E21B 41/02* (2006.01)
*E21B 43/27* (2006.01)

(52) U.S. Cl.
CPC ..... *E21B 21/08* (2013.01); *E21B 41/02* (2013.01); *E21B 43/27* (2020.05)

(58) Field of Classification Search
CPC ..... C09K 8/03; C09K 8/532; C09K 2208/20; C09K 2208/32
See application file for complete search history.

(56) References Cited

U.S. PATENT DOCUMENTS

2005/0166961 A1 8/2005 Means et al.
2018/0252101 A1* 9/2018 Bartetzko ..... E21B 44/00

FOREIGN PATENT DOCUMENTS

CN 111948328 A 11/2020
CN 114864008 A 8/2022
EP 3505590 A1 7/2019
WO 2014209722 A1 12/2014
WO 2018001629 A1 1/2018

OTHER PUBLICATIONS

Yunjiao Fu, "Reactive Transport Modeling to Quantify Key Reservoir Properties Affecting H2S Concentration Resulting from Therochemical Sulfate Reduction", International Petroleum Technology Conference, IPTC-20186 Abstract, Jan. 13-15, 2020.
Gasparrini et al., "Innovative Approaches of Carbonate Diagenesis Characterization to Predict Thermochemical Sulphate Reduction (TSR) Occurrence in Sedimentary Basins", AAPG Middle East Region GTW, Regional Variations in Charge Systems and the Impact on Hydrocarbon Fluid Properties in Exploration, 2019.
Guichet et al., "Thermochemical Sulfate Reduction (TSR): H2S Risk Assessment at the Basin Scales", AAPG 2017 Annual Convention and Exhibition, Apr. 2-5, 2017.
Peters et al., "Recent Advances in Petroleum System Modeling of Geochemical Processes: TSR, SARA, and Biodegradation", AAPG Annual Convention and Exhibition, May 19-22, 2013.
International Search Report and Written Opinion pertaining to PCT/CN2022/115818 dated Dec. 20, 2022, 9 pages.

* cited by examiner

SYSTEMS AND METHODS FOR WELLBORE DRILLING UTILIZING A THERMOCHEMICAL SULFATE REDUCTION (TSR) PROXY

CROSS-REFERENCE TO RELATED APPLICATIONS

This Application is a continuation of International Application No PCT/CN2022/115818, filed Aug. 30, 2022, the entire contents of which are incorporated herein by reference.

TECHNICAL FIELD

Embodiments described herein generally relate to, systems and methods for wellbore drilling utilizing a thermochemical sulfate reduction (TSR) proxy and, more specifically, to embodiments for modifying a drilling fluid for hydrocarbon extraction in a wellbore utilizing the TSR proxy.

BACKGROUND

Extracting hydrocarbons from subsurface formations may require drilling a hole from the surface to the subsurface formation containing the hydrocarbons through a wellbore or borehole. Thermochemical sulfate reduction (TSR) is a process that naturally occurs within a wellbore, where crystalline anhydrite ($CaSO_4$) reacts with hydrocarbons at elevated temperatures to generate high concentrations of hydrogen sulfide ($H_2S$) in carbonate reservoirs. TSR can destroy in-situ hydrocarbon resources as hydrogen sulfide is generated from the reaction. Additionally, the TSR process may cause corrosion and scale in the wellbore and the production facilities. Hydrogen sulfide is also toxic and has serious safety and environmental issues for the upstream operations in oil industry. As a result, the TSR process may increase the cost of hydrocarbon extraction through increased maintenance and mitigation of these effects in the wellbore and increased downtime to relocate a drilling system to an alternative region when drilling conditions are disadvantageous or inoperable. Thus, a need exists in the art for systems and methods for wellbore drilling that may de-risk drilling operations in wellbores that include hydrogen sulfide.

SUMMARY

Some embodiments for wellbore drilling utilizing a TSR proxy can include a wellbore drilling system comprising a drilling fluid tank that holds wellbore drilling fluid for introduction into a wellbore, an additive distribution component fluidly coupled to the drilling fluid tank that holds a first additive, and a computing device communicatively coupled to the additive distribution component. The computing device including a processor and a memory component, the memory component storing logic that, when executed by the processor, causes the wellbore drilling system to perform at least the following: receive drilling parameters identifying wellbore drilling conditions of the wellbore drilling system; calculate a thermochemical sulfate reduction (TSR) proxy value of the wellbore, wherein the TSR proxy value predicts progression of a TSR reaction in the wellbore, and wherein the TSR proxy value predicts a hydrogen sulfide concentration in the wellbore; and determine whether the predicted hydrogen sulfide concentration meets a first threshold. In response to determining that the predicted hydrogen sulfide concentration meets the first threshold, the wellbore drilling system can: determine a first quantity of the first additive to be added to the drilling fluid tank to increase a concentration of the first additive in the wellbore drilling fluid, and send an instruction to the additive distribution component to release the first quantity of the first additive to the drilling fluid tank.

Other embodiments include methods of preparing wellbore drilling fluid comprising a computing device performing at least the following: receiving drilling parameters that identify wellbore drilling conditions of a wellbore drilling system; calculating a thermochemical sulfate reduction (TSR) proxy value of the wellbore, where the TSR proxy value predicts the progression of a TSR reaction in a wellbore, and the TSR proxy value predicts a hydrogen sulfide concentration in the wellbore; in response to determining that the predicted hydrogen sulfide concentration meets a predetermined threshold: determining a first quantity of a first additive to be added to the wellbore drilling fluid; and combining the first quantity of the first additive with the wellbore drilling fluid.

Additional features and advantages of the described embodiments will be set forth in the detailed description, which follows, and in part will be readily apparent to those skilled in the art from that description or recognized by practicing the described embodiments, including the detailed description, which follows, as well as the claims.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
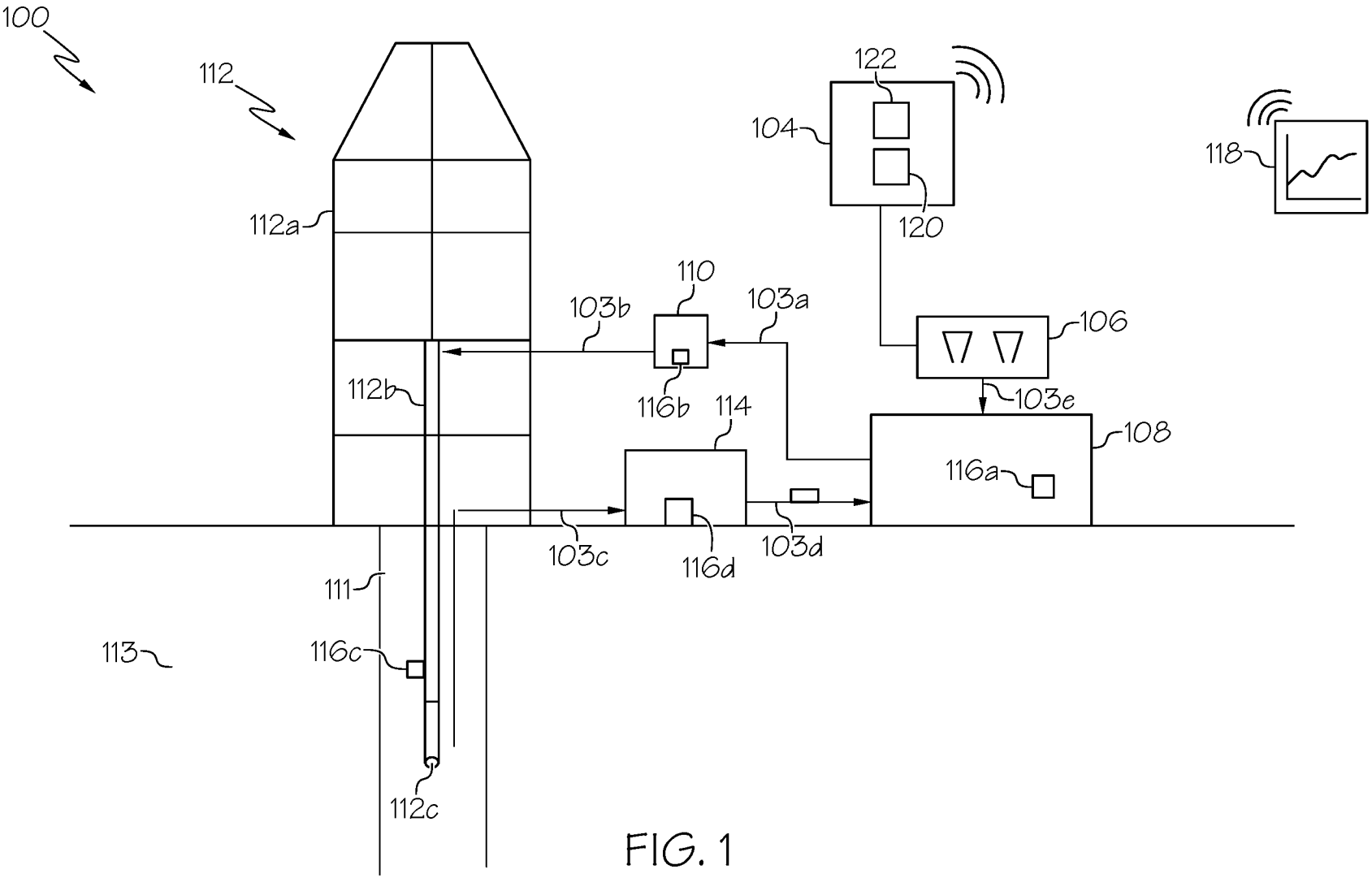
FIG. 1 depicts a wellbore drilling system, according to one or more embodiments shown and described herein.

Embodiments of the present disclosure are directed to systems and methods for wellbore drilling utilizing a TSR proxy. During wellbore drilling, hydrogen sulfide may be encountered. Embodiments disclosed herein may predict a concentration of hydrogen sulfide in the wellbore, modify a concentration of additives in wellbore drilling fluid to mitigate some effects of increased hydrogen sulfide, and monitor both the hydrogen sulfide concentration in the wellbore and additive concentration in the wellbore drilling fluid in real time. In embodiments, the wellbore drilling fluid may be modified further to adapt to the changes that occur to the hydrogen sulfide in the wellbore and the additive concentrations in the wellbore drilling fluid. In embodiments, a computing device may carry out these calculations, monitoring, and system changes in a single automated system. Embodiments disclosed herein may de-risk drilling operations when encountering hydrogen sulfide.

As used throughout this disclosure, the terms "downhole" and "uphole" may refer to a position within a wellbore relative to the surface, with uphole indicating direction or position closer to the surface and downhole referring to direction or position farther away from the surface.

As described in the present disclosure, a "subsurface formation" may refer to a body of rock that is sufficiently distinctive and continuous from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

As used throughout this disclosure, "wellbore," may refer to a drilled hole or borehole extending from the surface of the Earth down to the subsurface formation, including the openhole or uncased portion. The wellbore may form a pathway capable of permitting fluids to traverse between the surface and the subsurface formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

The "wellbore wall" may refer to the interface through which fluid may transition between the subsurface formation and the interior of the wellbore. The wellbore wall may be unlined (that is, bare rock or formation) to permit such interaction with the subsurface formation or lined, such as by a tubular string, so as to prevent such interactions. The wellbore wall may also define the void volume of the wellbore.

As used throughout this disclosure, "thermochemical sulfate reduction" (TSR), may refer to the reduction of sulfate in the presence of petroleum and heat. TSR may generate a variety of reaction products, including reduced forms of sulfur (S and $H_2S$), calcite and $CO_2$, as well as a combination of water, sulfides, organosulfur compounds, and bitumen, at the expense of hydrocarbon alteration.

Referring now to the drawings, FIG. 1 depicts a wellbore drilling system 100, according to one or more embodiments shown and described herein. The wellbore drilling system 100 can be used in forming vertical, deviated, or horizontal wellbores. The wellbore drilling system 100 includes a drilling rig 112 that is supported by a drill derrick 112*a*. The drill derrick 112*a* selectively positions a drill string 112*b* in the wellbore 111. The drill string 112*b* has a downhole end connected to a drill bit 112*c* that extends the wellbore 111 in the geologic formation 113. During wellbore drilling operations, wellbore drilling fluid (also called drilling mud or mud) is circulated through the wellbore 111 drilled by the drill bit 112*c*.

For example, a drilling fluid tank 108 holds the wellbore drilling fluid. A wellbore pump 110 is fluidly connected to the drilling fluid tank 108 via 103*a*. The drilling rig 112 is fluidly connected to the wellbore pump 110 via 103*b*. The wellbore pump 110 draws the wellbore drilling fluid from the drilling fluid tank 108 and directs the wellbore drilling fluid to the drilling rig 112, which then flows into the formation through the drill string 112*b* and the drill bit 112*c*. Wellbore drilling fluid in the wellbore may be directed to a shaker system 114 at the surface of the geologic formation 113 via 103*c*. The shaker system 114 may receive the wellbore drilling fluid which may comprise cuttings (i.e. solid material removed from the wellbore 111 during drilling) and other debris. The shaker system 114 may separate the cuttings and debris from the wellbore drilling fluid by directing the wellbore drilling fluid through a vibrating screen to allow the wellbore drilling fluid to be reused. The filtered wellbore drilling fluid may then be directed to the drilling fluid tank 108 via 103*d*, from where the wellbore drilling fluid circulation process continues. The flow pathways 103*a*-103*d* may be configured as piping and/or tubing.

The wellbore drilling fluid may be a water-based drilling fluid or an oil-based drilling fluid. In some embodiments, the water-based drilling fluid may include an aqueous component. Similarly, the aqueous component may include fresh water, salt water, brine, municipal water, formation water, produced water, well water, filtered water, distilled water, sea water, and/or combinations thereof. The brine may include at least one of natural and/or synthetic brine, such as saturated brine or formate brine. In some embodiments, the oil-based drilling fluid may include a hydrocarbon component. The hydrocarbon component may include diesel, kerosene, fuel oil, a crude oil, mineral oil, or combinations thereof. In embodiments, the oil-based drilling fluid may additionally include the aqueous component as previously described.

Other additives may be included in the wellbore drilling fluid of the present disclosure. Such additives may include, but are not limited to, proppants, viscosifiers, pH adjusting agents, wetting agents, corrosion inhibitors, scale inhibitors, oxygen scavengers, anti-oxidants, biocides, surfactants, dispersants, interfacial tension reducers, mutual solvents, thinning agents, breakers, crosslinkers, and combinations thereof. The identities and use of the additives are not particularly limited and may be any suitable additive known to a person of ordinary skill in the art. One of ordinary skill in the art will, with the benefit of this disclosure, appreciate that the inclusion of a particular additive will depend upon the desired application and properties of one or more embodiments of the wellbore drilling fluid.

The wellbore drilling system 100 also includes an additive distribution component 106 which is fluidly coupled to the drilling fluid tank 108 via 103*e*. The flow pathway 103*e* may be configured as piping and/or tubing. The additive distribution component 106 may hold one or more additives of different chemical functions, for example, hydrogen sulfide scavengers, corrosion inhibitors, biocides, chlorinating agents, and other functions. The additive distribution component 106 is coupled to the drilling fluid tank 108 to transfer quantities of the additives in the additive distribution component 106 into the drilling fluid tank 108. The additives received by the drilling fluid tank 108 are mixed with the wellbore drilling fluid in the drilling fluid tank 108, thereby "making up" the wellbore drilling fluid to account for the decreases in the concentrations of the additives in the wellbore drilling fluid.

Specifically, prior to commencing the drilling operation, additives may be introduced into the wellbore drilling fluid to mitigate the effects of the TSR reaction and improve drilling operations. Over time, the wellbore drilling fluid may be "made up," that is, the concentration of the additives in the wellbore drilling fluid may increase, so that the additives may continue to provide the desired function throughout the drilling operations in the wellbore 111.

The additives are added to the drilling fluid tank 108 and the solution of wellbore drilling fluid and additives is directed into the wellbore at the drilling rig 112 as described above. As additives may be lost during circulation through the wellbore, the concentration of the additives in the wellbore drilling fluid that are directed from the wellbore pump 110 to the drilling rig 112 may be greater than the concentration of the additives in the wellbore drilling fluid that is directed out of the wellbore 111 and into the shaker system 114. As the shaker system 114 removes cutting and debris from the wellbore drilling fluid, a quantity of the additives in the wellbore drilling fluid may be reduced. Accordingly, the concentration of the additives in the wellbore drilling fluid that is directed from the shaker system 114 to the drilling fluid tank 108 may be less than the concentration of the additives in the wellbore drilling fluid that flow out of the drilling rig 112 and into the shaker system 114. Additives from the additive distribution component 106 may be directed to the wellbore drilling fluid in the drilling fluid tank 108 to maintain or increase a concentration of additives in the wellbore drilling fluid.

The wellbore drilling system 100 additionally includes a computing device 104 that is coupled to the additive distribution component 106. In some implementations, the computing device 104 can be implemented as a computer system that includes a memory component 120 and a processor 122 to perform operations described in this disclosure.

In some implementations, the computing device 104 can receive drilling parameters identifying wellbore drilling conditions of the wellbore drilling system 100. In some embodiments, the wellbore drilling system 100 may include one or more sensors 116 to monitor a concentration of one more additives in the wellbore drilling fluid (e.g., 116*a* in the drilling fluid tank 108, 116*b* in the wellbore pump 110, 116*c* in the wellbore 111, and/or 116*d* in the shaker system 114), and the sensors may report the concentrations to the computing device 104. Additionally, the computing device 104 can send instructions to the wellbore pump 110 to modify a flow rate of the wellbore drilling fluid from the drilling fluid tank 108 to the wellbore 111. In embodiments, the flow rate of the pump may be altered to change a volume of the wellbore drilling fluid in the wellbore. Some embodiments may be configured such that the computing device 104 calculates a TSR proxy value, as described in more detail below. Based, in part, on the received drilling parameters and the calculated TSR proxy value, the computing device 104 can determine a type and/or quantity of additives to be included with the wellbore drilling fluid in the drilling fluid tank 108. Further, the computing device 104 can control the additive distribution component 106 to release the determined additives into the drilling fluid tank 108 to make up the wellbore drilling fluid.

Figure 2:
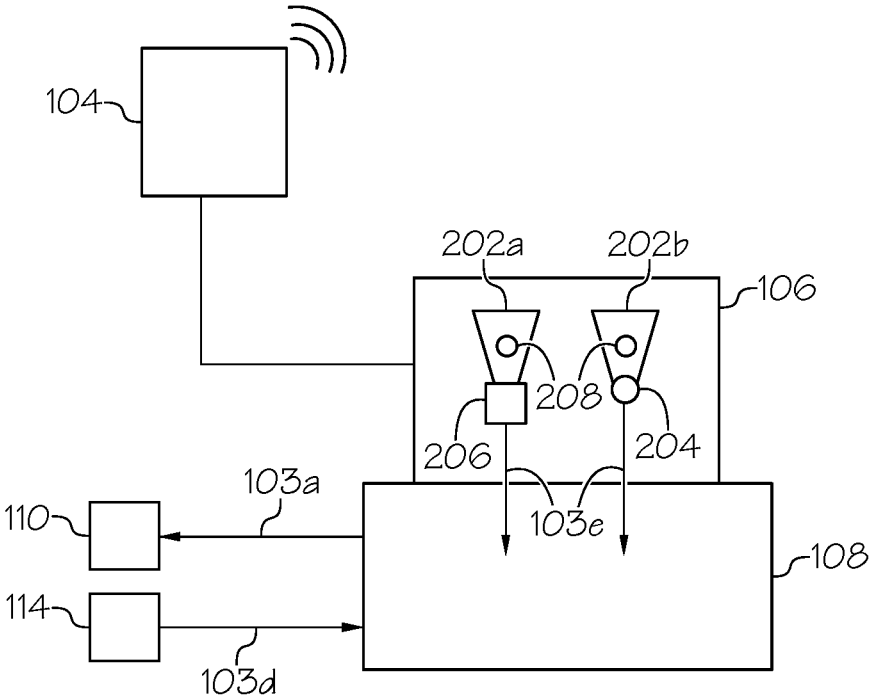
FIG. 2 depicts an additive distribution component and other components of the wellbore drilling system, according to one or more embodiments shown and described herein.

FIG. 2 depicts an additive distribution component 106 and other components of the wellbore drilling system, according to one or more embodiments shown and described herein. As illustrated, the computing device 104 is operatively coupled to the additive distribution component 106, which can include one or more reservoirs 202 containing one or more additives. For example, the reservoirs 202 may include a hydrogen sulfide scavenger reservoir 202*a* that stores hydrogen sulfide scavenger compounds, a corrosion inhibitor reservoir 202*b* that stores corrosion inhibitor compounds, and/or one or more additional reservoirs, such as a biocide reservoir comprising one or more biocide chemicals or a chlorinating agent reservoir comprising one or more chlorinating agents.

In some embodiments, the additive distribution component 106 may have only one reservoir 202, such as the hydrogen sulfide scavenger reservoir 202*a*. In some embodiments, the additive distribution component 106 may have two reservoirs 202, such as the hydrogen sulfide scavenger reservoir 202*a* and the corrosion inhibitor reservoir 202*b*. In some embodiments, the additive distribution component 106 may have more than two reservoirs, which may include any combination of the hydrogen sulfide scavenger reservoir 202*a*, the corrosion inhibitor reservoir 202*b*, a biocide reservoir comprising one or more biocide chemicals, a chlorinating agent reservoir comprising one or more chlorinating agents, and/or a combined reservoir comprising any combination of hydrogen sulfide scavengers, corrosion inhibitors, biocides, and/or chlorinating agents.

The additive distribution component 106 and thus the reservoirs 202 are connected to the drilling fluid tank 108 such that the additives released from the additive distribution component 106 are directed into the drilling fluid tank 108 to be mixed with the wellbore drilling fluid. In some embodiments, each additive distribution component 106 may include a valve 204 that can be actuated in response to a signal from the computing device 104. Depending on the physical properties of each additive type in each reservoir 202 (for example, weight, density, volume and/or other physical properties), the computing device 104 can actuate the valve for a duration sufficient to release a determined quantity of additives into the drilling fluid tank 108. By opening or closing the valves of each reservoir 202 for appropriate durations, the computing device 104 can add the desired quantities of additives of different types to make-up the wellbore drilling fluid to a level sufficient to improve wellbore drilling efficiency and safety.

Specifically, hydrogen sulfide scavengers introduced into the wellbore drilling fluid may reduce the concentration of hydrogen sulfide present in the wellbore 111, which may reduce the toxic and environmental effects of hydrogen sulfide generation. Non-limiting examples of hydrogen sulfide scavengers may include oxidants such as inorganic peroxides such as sodium peroxide, or chlorine dioxide, aldehydes or dialdehydes, such as $C_1$-$C_{10}$ aldehydes, formaldehyde, glutaraldehyde, ((meth)acrolein or glyocxal), triazines such as monoethanol amine triazine, and monomethylamine triazine and hydantoins such as hydroxyalkylhydantoins, bis(hydroxyalkyl)hydantoins and dialkylhydantoins where the alkyl group is a $C_1$-$C_6$ alkyl group. Other non-limiting examples of hydrogen sulfide scavengers include iron salts, such as iron oxides and/or iron hydroxides, both of which can react with hydrogen sulfide gas to form iron sulfide. Corrosion inhibitors introduced into the wellbore drilling fluid may reduce corrosion in the wellbore 111 and/or production facilities. Hydrogen sulfide acidifies water present in the wellbore, which causes increased corrosion of drilling pipes and equipment. Thus, a higher concentration of hydrogen sulfide in the wellbore may cause a greater amount of corrosion of drilling pipes and equipment if left untreated. Accordingly, an increased amount of corrosion inhibitor compounds may be added to the wellbore drilling fluid to reduce a corrosion rate in the wellbore. Non-limiting examples of corrosion inhibitors may include amidoamines, quaternary amines, amides, phosphate esters, or combinations thereof. Biocide chemicals introduced into the wellbore drilling fluid may inhibit microbial induced biofilm and corrosion.

A fluid compressor 206 may be connected to one or more reservoirs 202. The computing device 104 may instruct the fluid compressor to activate depending on the data processed and the determined amount of each additive from each of the reservoirs 202. The computing device 104 may cause the fluid compressor 206 to stop once a desired amount or concentration of the additive is present in the drilling fluid tank 108 or other area of the drilling system. In some cases, each reservoir 202 may contain one or more weight sensors 208 to determine a quantity of the additives in each reservoir 202 and the need to refill.

The computing device 104 may be configured to receive drilling parameters from one or more sensors 116 identifying wellbore drilling conditions of the wellbore drilling system 100. The computing device 104 may calculate a TSR proxy value, based on conditions and/or characteristics of the wellbore, drilling parameters, wellbore modeling, and/or measured wellbore conditions. Non-limiting variables used in the TSR proxy calculations may include a depth in the subsurface formation where the wellbore is being drilled, anhydrite mass in the wellbore, hydrogen sulfide concentration, hydrocarbon composition and volume, formation age, burial and thermal histories of the formation, and kinetic parameters of TSR, where each respective variable may be modeled and/or measured. In embodiments, a minimum of one variable, such as the depth in the subsurface formation where the wellbore is being drilled, may be used in the TSR proxy calculation.

Figure 3:
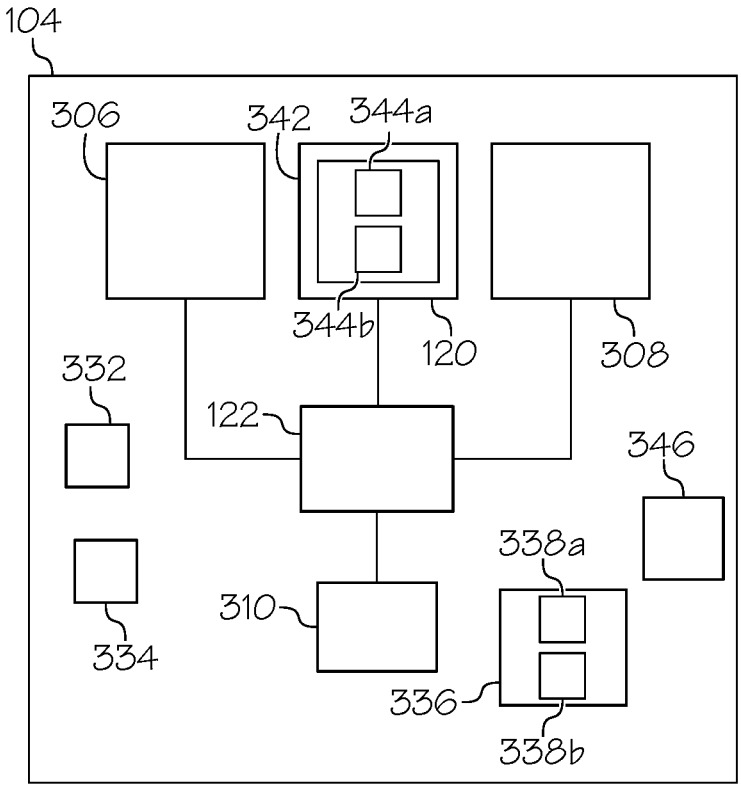
FIG. 3 depicts the computing device of the wellbore drilling system, according to one or more embodiments shown and described herein.

FIG. 3 depicts the computing device 104 of the wellbore drilling system 100, according to one or more embodiments shown and described herein. As illustrated, the computing device 104 includes a processor 122, input/output hardware 332, network interface hardware 334, a data storage component 336 (which stores well data 338*a*, command data 338*b*, and/or other data), and the memory component 120. The memory component 120 may be configured as volatile and/or nonvolatile memory and as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. Depending on the particular embodiment, these non-transitory computer-readable mediums may reside within the user computing device 104 and/or external to the user computing device 104.

The memory component 120 may store operating logic 342, the calculation logic 344*a* and the actuation logic 344*b*. The calculation logic 344*a* and the actuation logic 344*b* may each include a plurality of different pieces of logic, each of which may be embodied as a computer program, firmware, and/or hardware, as an example. A local interface 346 is also included in FIG. 3 and may be implemented as a bus or other communication interface to facilitate communication among the components of the user computing device 104.

The processor 122 may include any processing component operable to receive and execute instructions (such as from a data storage component 336 and/or the memory component 120). The input/output hardware 332 may include and/or be configured to interface with sensors, microphones, speakers, a display, and/or other hardware associated with the wellbore.

The network interface hardware 334 may include and/or be configured for communicating with any wired or wireless networking hardware, including an antenna, a modem, LAN port, wireless fidelity (Wi-Fi) card, WiMax card, ZigBee card, Bluetooth chip, USB card, mobile communications hardware, and/or other hardware for communicating with other networks and/or devices. From this connection, communication may be facilitated between the user computing device 104 and other devices and/or sensors.

The operating logic 342 may include an operating system and/or other software for managing components of the user computing device 104. As also discussed above, the calculation logic 344*a* and the actuation logic 344*b* may reside in the memory component 120 and may be configured to perform the functionality, as described herein.

It should be understood that while the components in FIG. 3 are illustrated as residing within the user computing device 104, this is merely an example. In some embodiments, one or more of the components may reside external to the user computing device 104. It should also be understood that, while the user computing device 104 is illustrated as a single device, this is also merely an example. In some embodiments, the calculation logic 344*a* and the actuation logic 344*b* may reside on different computing devices. As an example, one or more of the functionalities and/or components described herein may be provided by a user computing device 104 and/or other devices (such as the wellbore system 100), which may be coupled to the user computing device 104 via a network.

Additionally, while the user computing device 104 is illustrated with the calculation logic 344*a* and the actuation logic 344*c* as separate logical components, this is also an example. In some embodiments, a single piece of logic (and/or or several linked modules) may cause the user computing device 104 to provide the described functionality.

As described above, the computing device 104 receives drilling parameters from one or move sensors 116 measuring one or more drilling parameters. For example, the sensors 116 can measure a rate of penetration of the drill bit, a flow rate of the wellbore drilling fluid through the wellbore drilling system 100, additive concentrations present in the wellbore drilling fluid, and hydrogen sulfide concentration in the wellbore to name a few. Additional drilling parameters that can be measured by one or more additional sensors 116 can include, for example, percentage of cuttings coming out of the shaker system 114, additive concentrations of the wellbore drilling fluid flowing from the wellbore pump 110 to the drilling rig 112, additive concentrations of the wellbore drilling fluid flowing from the drilling rig 112 to the shaker system 114, and additive concentrations of the wellbore drilling fluid flowing from the shaker system 114 to the drilling fluid tank 108. In some embodiments, the system may comprise one or more hydrogen sulfide sensors operable to quantify a concentration of hydrogen sulfide at a specific position within the subsurface formation. In embodiments, the computing device 104 may receive the measured concentration of hydrogen sulfide in the wellbore, compare the measured concentration of hydrogen sulfide to the predicted concentration based on the TSR proxy, and modify the TSR proxy calculation to calibrate the model based on the measured concentration.

The computing device 104 can store one or more models that identify a desired concentration value of each respective additive for the wellbore drilling fluid and concentrations of additives that need to be added to the drilling fluid tank 108 to achieve each desired concentration. Further, the computing device 104 can store one or more models that predict the concentration of hydrogen sulfide gas present in the wellbore based on wellbore depth, hydrocarbon composition and volume, anhydrite availability in the wellbore, the TSR proxy value, and/or other drilling parameters. In embodiments, the computing device 104 may determine a corrosion parameter based in part, on the hydrogen sulfide concentration, wellbore depth, temperature, hydrocarbon composition and volume, anhydrite availability in the wellbore, the TSR proxy value, and/or other drilling parameters. The corrosion parameter may be used to predict an amount of corrosion inhibitor compounds that may be added to the wellbore drilling fluid to reduce corrosion of the wellbore drilling system components. In response to a greater corrosion parameter value, an increased amount of corrosion inhibitor compounds may be added to the wellbore drilling fluid.

The computing device 104 may use a hydrogen sulfide concentration, calculated or measured, to determine a quantity of the hydrogen sulfide scavenger additive to add to the drilling fluid tank 108 to reach a predetermined concentration of the hydrogen sulfide scavenger in the wellbore drilling fluid.

In embodiments, the computing device 104 can determine a change in the concentration of additives in the wellbore drilling fluid that has been circulated through the wellbore drilling system 100. For example, based on the wellbore drilling fluid flow rate and the concentration of additives in the wellbore drilling fluid, the computing device 104 can determine that a concentration of the additives has decreased from an initial concentration. In response, the computing device 104 can determine a quantity of the additives to be added to the wellbore drilling fluid to make up the lost concentration. In addition, the computing device 104 can identify different additive types (for example, hydrogen sulfide scavengers and corrosion inhibitors) and the quantity of each additive type to be added to the wellbore drilling fluid.

In embodiments, the computing device 104 may use the drilling parameters received from the sensors, the calculated TSR proxy value from the TSR proxy, the calculated hydrogen sulfide concentration in the wellbore, and/or the corrosion parameter to detect that a concentration of one more additives in the wellbore drilling fluid is below a desired concentration. In response, the computing device 104 can determine an additional quantity of the additives to be added to the wellbore drilling fluid to change the concentration of the additives in the wellbore drilling fluid.

In embodiments, the computing device 104 may store logic (such as the calculation logic 344*a* and/or the actuation logic 344*b* from FIG. 3) that, when executed by the processor 122 causes the wellbore drilling system 100 to perform at least the following: receive drilling parameters that identify wellbore drilling conditions of a wellbore drilling system; calculate a thermochemical sulfate reduction (TSR) proxy value of the wellbore, where the TSR proxy value is able to predict the progression of a TSR reaction in a wellbore, and the TSR proxy value is able to predict a hydrogen sulfide concentration in the wellbore; determine a first quantity of a first additive to be added to the wellbore drilling fluid, if the predicted hydrogen sulfide concentration is above a first threshold; combine the first quantity of the first additive with the wellbore drilling fluid; determine a corrosion parameter, based on the predicted hydrogen sulfide concentration in the wellbore; determine a second quantity of a second additive to be added to the wellbore drilling fluid if the corrosion inhibitor is above a second threshold; and combine the second quantity of the second additive with the wellbore drilling fluid.

Figure 4:
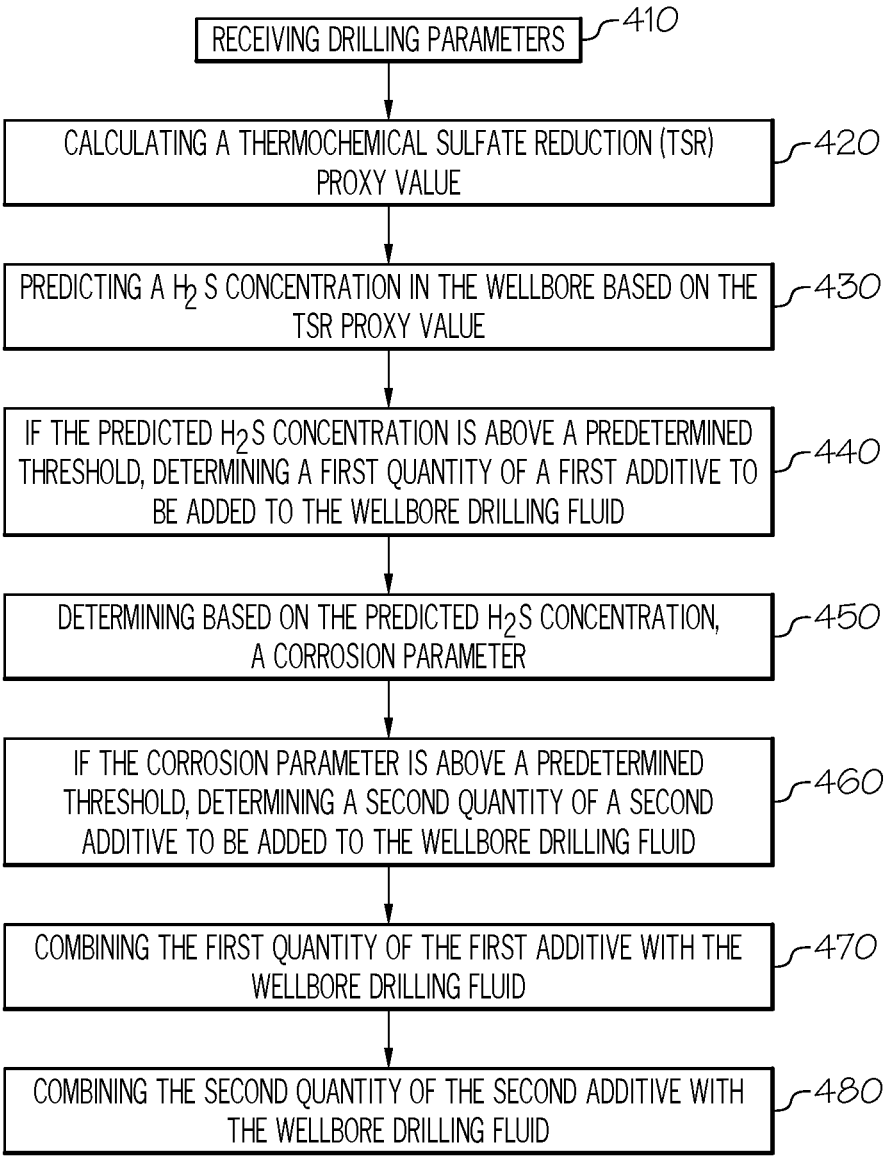
FIG. 4 depicts a process flow chart, according to one or more embodiments shown and described herein.

FIG. 4 depicts a representative process of embodiments described herein. In block 410, drilling parameters may be received. The drilling parameters may include, but are not limited to a rate of penetration of a drill bit into the formation 111, a flow rate of the wellbore drilling fluid through the wellbore, a depth in the subsurface formation where the wellbore is being drilled, and a temperature of the subsurface formation. In block 420, a thermochemical sulfate reduction (TSR) proxy value may be calculated. As described above, the TSR proxy value may be calculated based on a depth in the subsurface formation wherein the wellbore is being drilled, anhydrite mass in the wellbore, and hydrocarbon composition and volume, where each respective variable may be modeled and/or measured. In block 430 a hydrogen sulfide concentration in the wellbore may be predicted based on the TSR proxy value. The prediction takes into consideration the calculated progression of the TSR reaction in the wellbore, which produces hydrogen sulfide, and an estimated volume of wellbore to calculate a predicted concentration of hydrogen sulfide in the wellbore. In block 440, if the predicted hydrogen sulfide concentration meets a predetermined threshold, a first quantity of a first additive to be added to the wellbore drilling fluid may be determined. The first quantity of the first additive may be determined based on a desired concentration of the first additive in the wellbore drilling fluid, a current concentration of the first additive in the wellbore drilling fluid, and the volume of the wellbore drilling fluid in the drilling fluid tank 108. In block 450, based on the predicted hydrogen sulfide concentration, a corrosion parameter may be determined. The corrosion parameter may be used to quantify a rate of corrosion in the wellbore. The corrosion parameter may be determined based on the predicted hydrogen sulfide concentration and temperature of the wellbore. Methods known in the art for modeling $H_2S$ corrosion may also be implemented to calculate the corrosion parameter. For instance, a mechanistic model of corrosion of steel as a function of hydrogen sulfide concentration and temperature is reported in Sun, W.; Nesic, S. (2007) A mechanistic model of $H_2S$ corrosion of mild steel. Corrosion. NACE-07655. In block 460, if the corrosion parameter is above a predetermined threshold, a second quantity of a second additive to be added to the wellbore drilling fluid may be determined. This second quantity may be determined, based on a desired concentration of the second additive in the wellbore drilling fluid, a current concentration of the second additive in the wellbore drilling fluid, and the volume of the wellbore drilling fluid in the drilling fluid tank 108. In block 470, an instruction to add the first quantity of the first additive with the wellbore drilling fluid may be sent to the additive distribution component 106. In block 480, an instruction to add the second quantity of the second additive with the wellbore drilling fluid may be sent to the additive distribution component 106.

As an example, a general reaction for the TSR may be written as:

$$\text{Sulphate+petroleum=calcite+}H_2S\text{+}H_2O\pm CO_2\pm S\pm\text{altered petroleum} \quad (1)$$

The kinetic parameters of TSR, describing the reaction rates, may be used to quantify the process and extent of the TSR reaction. The TSR reaction can be approximated by a first-order kinetic reaction. The integrated first-order rate law can be expressed by the Arrhenius equation, which is used to extrapolate the rate constant at each temperature. The temperature dependent rate constant ($k_{Ci,t}$) can be calculated as:

$$k_{C_i,t} = A_{C_i} \times \exp\left(-\frac{E_{a,C_i}}{RT}\right) \quad (2)$$

where $A_{Ci}$ is the Arrhenius pre-exponential factor (mol/s) for the component $C_i$, $E_{\alpha,Ci}$ is the activation energy (J/mol) for the component $C_i$, T is the temperature (K), and R is the gas constant.

The cumulative TSR reaction is the integration of component-specific and temperature-dependent TSR reaction rate in a specific reaction duration. It can be written as:

$$TSR_{C_i} = \int_{t_0}^{t_1} k_{C_i,t} dt \quad (3)$$

where $TSR_{Ci}$ is the cumulative TSR reaction (mol/ton) for hydrocarbon component $C_i$ (e.g., $C_1$, $C_2$, $C_3$ . . . , $C_i$). $k_{Ci,t}$ is the rate constant of the TSR reactions (mol/ton/s) of $C_i$ at a temperature (K) at the time t (s). $t_0$ and $t_1$ are times which TSR reaction begins and ends, respectively.

For reduced computational efforts and improved efficiency, the hydrocarbon compositions may be grouped into four groups: dry gas ($C_1$), wet gas ($C_2$-$C_5$), light oil ($C_6$-$C_{14}$) and heavy oil ($C_{15}$+). The TSR reaction rate is calculated based on these four groups, instead of each individual component. The rate constant of a specific group of hydrocarbon component ($k_{Ci}$) can be calculated using the activation energy and frequency factor obtained from the TSR experiments reported in literature. For instance, the activation energy and frequency factor for $C_1$ and $C_3$ are reported in Yue, C., Li, S., Ding, K., & Zhong, N. (2006). Thermodynamics and kinetics of reactions between C1-C3 hydrocarbons and calcium sulfate in deep carbonate reservoirs. Geochemical Journal, 40(1), 87-94. The activation energy and frequency factor for light oil and heavy oil are reported in Zhang, T., Ellis, G. S., Ma, Q., Amrani, A., & Tang, Y. (2012). Kinetics of uncatalyzed thermochemical sulfate reduction by sulfur-free paraffin. Geochimica et Cosmochimica Acta, 96, 1-17.

The TSR proxy may be calculated as the sum of the TSR reaction of each hydrocarbon component ($C_i$), as shown below:

$$TSR_P = \sum_{i=1}^{n} TSR_{C_i} \quad (4)$$

where $TSR_P$ is the TSR proxy (mol/ton), n is the highest number of carbon atoms from hydrocarbon component $C_i$. In addition, amount of the product $H_2S$(g) and byproduct $CO_2$(g) may be calculated as a function of TSR proxy, based on equation 1.

Hydrocarbons present in the wellbore 111, excluding dry gas ($CH_4$), may be altered during thermal cracking and TSR reactions to form smaller molecule compounds (Eq. 1). For example, dry gas and wet gas may be generated from light and heavy oil. The altered hydrocarbons are accounted for and are added to the remaining quantities of the relevant hydrocarbon groups. For example, generated $C_1$ needs to be added to the remaining $C_1$ to become total remaining $C_1$ at the time of interest. The rate of generated altered hydrocarbons can be expressed as a function of TSR reaction rates:

$$k_{C_j,t} = a_{C_j} \times k_{C_i,t} \quad (5)$$

where $k_{C_j,t}$ is the generation rate of hydrocarbon component $C_j$ from the alteration of hydrocarbon component $C_i$ (mol/ton/s), and $a_{cj}$ is a coefficient for the positive correlation of the two rates. The $a_{cj}$ is 0.5 and 0.6 for $C_1$ and $C_2$-$C_5$, respectively.

The altered hydrocarbons can be calculated as the following function:

$$W_{A,C_j} = \sum_{j=m}^{n} \int_{t_0}^{t_1} k_{C_j,t} dt \quad (6)$$

where $W_{A,C_j}$ is the cumulative generated amount of hydrocarbon component $C_j$ due to alteration of light and heavy oil (hydrocarbon components $C_{m+}$) (mol/ton).

TSR reactions may include both sulfate and hydrocarbons as reactants. The hydrocarbons are generally available in the carbonate reservoirs. However, the abundance of anhydrite and its accessibility can be a restriction on the extent of TSR reaction. Anhydrite sources in a reservoir may comprise an inner part of the anhydrite nodules that may be inaccessible to the water and hydrocarbons. Thus, the calcite produced from the TSR reaction formed around the anhydrite nodules may have an armoring effect to prevent further reactions of anhydrite cores. Therefore, the unreacted cores of the nodules are ineffective (or non-reactive) anhydrite.

The amount of effective anhydrite (i.e. anhydrite that may participate in the TSR reaction) can be characterized and quantified by petrographic analysis of core samples and/or well-log studies. For example, petrographic thin-section analysis can characterize the particle size and types of anhydrite, whether they are small particles or nodules, and quantify them by point counting analysis. In case when cores are not available, well logs can be used to characterize whether the anhydrite is a thick layer or successive thin layers alternating with limestone or dolomite. Different ratios of reactive anhydrite may be assigned for thick-layer or thin-layer anhydrite; these ratios may be calibrated with data from nearby areas where the information is available.

The consumption of effective anhydrite is a function of the TSR reaction, according to the following equation:

$$8C_nH_m + (4n+m)CaSO_4(\text{anhydrite}) = (4n+m)CaCO_3(\text{calcite}) + (4n+m)H_2S(g) + (4n-m)CO_2(g) + (3m-4n)/2H_2O \quad (7)$$

The hydrocarbon composition (H/C ratio equal to m/n) drives the reaction stoichiometry. The effective anhydrite can be calculated using the following equation:

$$An_{r,t} = An_i - \sum_{i=1}^{n} x_{C_i} \times TSR_{C_i} \quad (8)$$

where $An_{r,t}$ is the remaining effective anhydrite; $An_i$ is initial effective anhydrite; $x_{Ci}$ is the reaction stoichiometry. For example, the stoichiometry for dry gas ($CH_4$) is 1. If we use $C_3$ ($C_3H_8$) as a proxy for wet gas ($C_2$-$C_5$), the stoichiometry is 0.4 (8/20). If $C_{10}$ ($C_{10}H_{22}$) is a proxy for light oil ($C_6$-$C_{14}$), the stoichiometry is 0.129 (8/62). If $C_{22}$ ($C_{22}H_{46}$) is a proxy for heavy oil ($C_{15}$+), the stoichiometry is 0.060 (8/134). If remaining anhydrite is less than or equal to 0, the modeled TSR reactions will stop.

Based on the above equations for each TSR reaction, the final formula for the calculation of the TSR proxy is:

$$TSR_P = \sum_{i=1}^{5} \left( \int_{t_0}^{t_1} A_{C_i} \times \exp\left(-\frac{E_{a,C_i}}{RT_t}\right) dt + \sum_{j=m}^{n} \int_{t_0}^{t_1} a_{C_i} \times A_{C_j} \times \exp\left(-\frac{E_{a,C_j}}{RT_t}\right) dt \right) + \sum_{i=6}^{n} \int_{t_0}^{t_1} A_{C_i} \times \exp\left(-\frac{E_{a,C_i}}{RT_t}\right) dt \quad (9)$$

When $An_{r,t} \leq 0$, and then $t_1 = t$;

where parameters in the above equation have been described previously. From the beginning of the TSR reaction ($t_0$), $An_{r,t}$ decreases gradually. When $An_{r,t} \leq 0$, the TSR reaction will stop and then the final $TSR_p$ is equal to $TSR_{p,t}$ at t reaction time.

The TSR proxy can be used to estimate the risk factor of $H_2S$ at a specific portion of the reservoir, according to Table 1. The $H_2S$ risk factor is a function of $H_2S$ concentration in the total gas produced from the reservoir. The ranking of the risk factor and the threshold levels of $H_2S$ concentration can be developed by an operator for different oil and gas fields based on operation safety, facility prevention and economic evaluation. The table below provides an example of the ranking of the risk factor from 0 to 12 for the $H_2S$ concentration from <0.1 ppm to >10%.

TABLE 1

| TSR Proxy | $H_2S$ Concentration | H2S Risk Factor |
|---|---|---|
| <0.1 | <0.1 ppm | 0 (lowest risk) |
| 0.1 | 10 ppm | 1 |
| 0.25 | 25 ppm | 2 |
| 0.5 | 50 ppm | 3 |
| 1.0 | 100 ppm | 4 |
| 2.5 | 250 ppm | 5 |
| 5.0 | 500 ppm | 6 |
| 10 | 1000 ppm | 7 |
| 100 | 1% | 8 |
| 200 | 2% | 9 |
| 500 | 5% | 10 |
| 1000 | 10% | 11 |
| >1000 | >10% | 12 (highest risk) |

Examples

In the following example, temperature dependent TSR reaction rates of each hydrocarbon group are approximated by using the activation energy (E a) and frequency factor (A) for each respective grouping, as reported in Table 2.

TABLE 2

| | Activation energy ($E_a$) (kJ/mol) | frequency factor (A) ($s^{-1}$) |
|---|---|---|
| Dry gas | 152.919 | 34632 |
| Wet gas | 120.582 | 57.75 |
| Light oil | 253.500 | $1.77 \times 10^{16}$ |
| Heavy oil | 246.600 | $4.05 \times 10^{14}$ |

Figure 5:
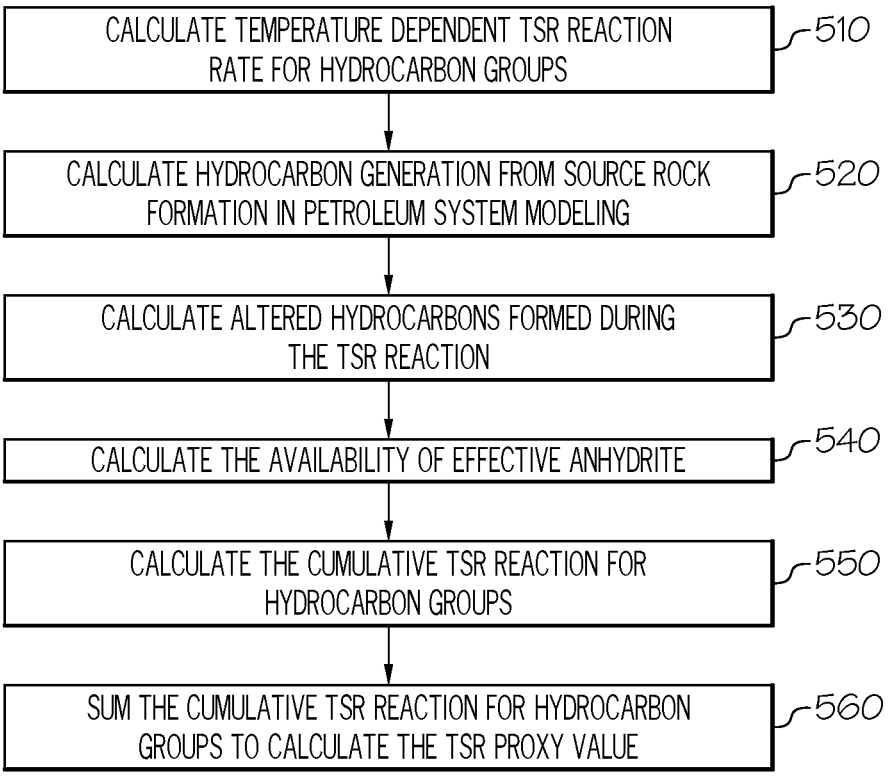
FIG. 5 depicts a process flow chart of the TSR proxy value calculation, according to one or more embodiments shown and described herein.

FIG. 5 depicts a flow diagram of the calculation of the TSR proxy value further described below. As illustrated in block 510, a temperature dependent TSR reaction rate may be calculated for one or more hydrocarbon groups. The temperature dependent TSR reaction rate may be calculated using the temperature dependent rate constant, detailed above in equation 2. A representative example of the temperature dependent TSR reaction rate for wet gas from 50° C. to 250° C. is reported below in Table 3.

TABLE 3

| T (° C.) | T (K) | Ea (J/mol) | Rate ($s^{-1}$) |
|---|---|---|---|
| 50 | 323.15 | 120582 | 7.63E−16 |
| 55 | 328.15 | 120582 | 1.87E−18 |
| 60 | 333.15 | 120582 | 3.70E−18 |
| 65 | 338.15 | 120582 | 7.18E−18 |
| 70 | 343.15 | 120582 | 1.37E−17 |
| 75 | 348.15 | 120582 | 2.55E−17 |
| 80 | 353.15 | 120582 | 4.68E−17 |
| 85 | 358.15 | 120582 | 8.45E−17 |

TABLE 3-continued

| T (° C.) | T (K) | Ea (J/mol) | Rate ($s^{-1}$) |
|---|---|---|---|
| 90 | 363.15 | 120582 | 1.50E−16 |
| 95 | 368.15 | 120582 | 2.62E−16 |
| 100 | 373.15 | 120582 | 4.50E−16 |
| 105 | 378.15 | 120582 | 7.63E−16 |
| 110 | 383.15 | 120582 | 1.28E−15 |
| 115 | 388.15 | 120582 | 2.10E−15 |
| 120 | 393.15 | 120582 | 3.43E−15 |
| 125 | 398.15 | 120582 | 5.51E−15 |
| 130 | 403.15 | 120582 | 8.76E−15 |
| 135 | 408.15 | 120582 | 1.38E−14 |
| 140 | 413.15 | 120582 | 2.14E−14 |
| 145 | 418.15 | 120582 | 3.29E−14 |
| 150 | 423.15 | 120582 | 5.00E−14 |
| 155 | 428.15 | 120582 | 7.53E−14 |
| 160 | 433.15 | 120582 | 1.12E−13 |
| 165 | 438.15 | 120582 | 1.66E−13 |
| 170 | 443.15 | 120582 | 2.44E−13 |
| 175 | 448.15 | 120582 | 3.54E−13 |
| 180 | 453.15 | 120582 | 5.10E−13 |
| 185 | 458.15 | 120582 | 7.28E−13 |
| 190 | 463.15 | 120582 | 1.03E−12 |
| 195 | 468.15 | 120582 | 1.45E−12 |
| 200 | 473.15 | 120582 | 2.03E−12 |
| 205 | 478.15 | 120582 | 2.82E−12 |
| 210 | 483.15 | 120582 | 3.88E−12 |
| 215 | 488.15 | 120582 | 5.31E−12 |
| 220 | 493.15 | 120582 | 7.23E−12 |
| 225 | 498.15 | 120582 | 9.77E−12 |
| 230 | 503.15 | 120582 | 1.31E−11 |
| 235 | 508.15 | 120582 | 1.75E−11 |
| 240 | 513.15 | 120582 | 2.33E−11 |
| 245 | 518.15 | 120582 | 3.07E−11 |
| 250 | 523.15 | 120582 | 4.04E−11 |

In block 520, after the temperature dependent TSR reaction rate is calculated for the four groups of hydrocarbons, the cumulative TSR reactions and hydrocarbon consumption for each group may be calculated, according to equations 3, 6, and 8. As noted above, hydrocarbon generation from source rock formation may calculated during the TSR reaction. Further, at least a portion of the light oil is altered to generate additional dry gas and wet gas. In block 530, altered hydrocarbons formed during the TSR reaction may be calculated. Specifically, the additional dry gas and wet gas may be accounted and added to the calculated cumulative TSR reaction for each respective group. In block 540, the availability of effective anhydrite may be calculated. As an example, the calculations of the cumulative TSR reaction of light oil is shown in Table 4. The cumulative reaction at each temperature corresponds to a modeled depth below the surface of the wellbore 111.

TABLE 4

| Time (mybp) | Temp (° C.) | Depth (m) | Cumulative C6-C14 (mol/ton) | C6-14 TSR Rates (mol/ton/s) | TSR C6-14 (mol/ton) | Total TSR C6-14 (mol/ton) | Generation C1 (mol/ton) | Culmulative_Generation_C1 (mol/ton) | Generation C2-5 (mol/ton) | Culmulative Generation_C2-5 (mol/ton) | Consumed Anhydrite (C6-14) (mol/ton) |
|---|---|---|---|---|---|---|---|---|---|---|---|
| 100 | 50 | 1333.3 | 0 | 1.87E−25 | 0 | 0 | 0 | 0 | 0 | 0 | 0 |
| 97.5 | 55 | 1500 | 6.66E−06 | 7.89E−25 | 6.22E−11 | 6.22E−11 | 3E−11 | 3E−11 | 4E−11 | 40E−11 | 8.02E−12 |
| 95 | 60 | 1666.7 | 2.85E−05 | 3.18E−24 | 2.51E−10 | 3.13E−10 | 1E−10 | 2E−10 | 2E−10 | 2E−10 | 4.04E−11 |
| 92.5 | 65 | 1833.3 | 9.80E−05 | 1.23E−23 | 9.71E−10 | 1.28E−09 | 5E−10 | 6E−10 | 6E−10 | 8E−10 | 1.66E−10 |
| 90 | 70 | 2000 | 3.11E−04 | 4.58E−23 | 3.61E−09 | 4.890E−09 | 2E−09 | 2E−09 | 2E−09 | 3E−09 | 6.31E−10 |
| 87.5 | 75 | 2166.7 | 9.46E−04 | 1.64E−22 | 1.29E−08 | 1.78E−08 | 6E−09 | 9E−09 | 8E−09 | 1E−08 | 2.30E−09 |
| 85 | 80 | 2333.3 | 2.78E−03 | 5.67E−22 | 4.47E−08 | 6.25E−08 | 2E−08 | 3E−08 | 3E−08 | 4E−08 | 8.07E−09 |
| 82.5 | 85 | 2500 | 7.90E−03 | 1.89E−21 | 1.49E−07 | 2.12E−07 | 7E−08 | 1E−07 | 9E−08 | 1E−07 | 2.73E−08 |
| 80 | 90 | 2666.7 | 2.18E−02 | 6.11E−21 | 4.82E−07 | 6.93E−07 | 2E−07 | 3E−07 | 3E−07 | 4E−07 | 8.95E−08 |
| 77.5 | 95 | 2833.3 | 5.87E−02 | 1.91E−20 | 1.51E−06 | 2.20E−06 | 8E−07 | 1E−06 | 9E−07 | 1E−06 | 2.84E−07 |
| 75 | 100 | 3000 | 0.15 | 5.80E−20 | 4.57E−06 | 6.77E−06 | 2E−06 | 3E−06 | 3E−06 | 4E−06 | 8.73E−07 |
| 72.5 | 105 | 3166.7 | 0.39 | 1.71E−19 | 1.35E−05 | 2.02E−05 | 7E−06 | 1E−05 | 8E−06 | 1E−05 | 2.61E−06 |
| 70 | 110 | 3333.3 | 0.96 | 4.89E−19 | 3.86E−05 | 5.88E−05 | 2E−05 | 3E−05 | 2E−05 | 4E−05 | 7.58E−06 |
| 67.5 | 115 | 3500 | 2.23 | 1.36E−18 | 1.08E−04 | 1.66E−04 | 5E−05 | 8E−05 | 6E−05 | 1E−04 | 2.14E−05 |
| 65 | 120 | 3666.7 | 4.84 | 3.70E−18 | 2.92E−04 | 4.58E−04 | 0.0001 | 0.0002 | 0.0002 | 0.0003 | 5.91E−05 |
| 62.5 | 125 | 3833.3 | 9.41 | 9.80E−18 | 7.73E−04 | 1.23E−03 | 0.0004 | 0.0006 | 0.0005 | 0.0007 | 1.59E−04 |
| 60 | 130 | 4000 | 15.77 | 2.53E−17 | 2.00E−03 | 3.23E−03 | 0.001 | 0.0016 | 0.0012 | 0.0019 | 4.16E−04 |
| 57.5 | 135 | 4166.7 | 22.78 | 6.40E−17 | 5.04E−03 | 8.27E−03 | 0.0025 | 0.0041 | 0.003 | 0.005 | 1.07E−03 |
| 55 | 140 | 4333.3 | 29.51 | 1.58E−16 | 1.25E−02 | 2.07E−02 | 0.0062 | 0.0104 | 0.0075 | 0.0124 | 2.67E−03 |
| 52.5 | 145 | 4500 | 35.20 | 3.82E−16 | 3.01E−02 | 5.08E−02 | 0.0151 | 0.0254 | 0.0181 | 0.0305 | 6.56E−03 |
| 50 | 150 | 4666.7 | 39.74 | 9.04E−16 | 7.13E−02 | 0.12 | 0.0356 | 0.0611 | 0.0428 | 0.0733 | 1.58E−02 |
| 47.5 | 155 | 4833.3 | 43.27 | 2.10E−15 | 0.17 | 0.29 | 0.0827 | 0.1437 | 0.0992 | 0.1724 | 3.71E−02 |
| 45 | 160 | 5000 | 46.12 | 4.77E−15 | 0.38 | 0.66 | 0.188 | 0.3318 | 0.2257 | 0.3981 | 8.56E−02 |
| 42.5 | 165 | 5166.7 | 48.40 | 1.07E−14 | 0.84 | 1.50 | 0.4199 | 0.7516 | 0.5038 | 0.9019 | 0.194 |
| 40 | 170 | 5333.3 | 50.06 | 2.34E−14 | 1.84 | 3.34 | 0.9206 | 1.6722 | 1.1048 | 2.0067 | 0.431 |
| 37.5 | 175 | 5500 | 50.65 | 5.03E−14 | 3.97 | 7.31 | 1.9836 | 3.6558 | 2.3803 | 4.387 | 0.943 |
| 35 | 180 | 5666.7 | 50.69 | 1.07E−13 | 8.40 | 15.7 | 4.202 | 7.8579 | 5.0424 | 9.4294 | 2.03 |
| 32.5 | 185 | 5833.3 | 50.69 | 2.22E−13 | 17.51 | 33.2 | 8.757 | 16.615 | 10.508 | 19.938 | 4.29 |
| 30 | 190 | 6000 | 50.69 | 4.56E−13 | 17.46 | 50.69 | 8.7289 | 25.344 | 10.475 | 30.412 | 6.54 |
| 27.5 | 195 | 6166.7 | 50.69 | 9.20E−13 | 0 | 50.69 | 0 | 25.344 | 0 | 30.412 | 6.54 |
| 25 | 200 | 6333.3 | 50.69 | 1.83E−12 | 0 | 50.69 | 0 | 25.344 | 0 | 30.412 | 6.54 |
| 22.5 | 205 | 6500 | 50.69 | 3.59E−12 | 0 | 50.69 | 0 | 25.344 | 0 | 30.412 | 6.54 |
| 20 | 210 | 6666.7 | 50.69 | 6.95E−12 | 0 | 50.69 | 0 | 25.344 | 0 | 30.412 | 6.54 |
| 17.5 | 215 | 6833.3 | 50.69 | 1.33E−11 | 0 | 50.69 | 0 | 25.344 | 0 | 30.412 | 6.54 |
| 15 | 220 | 7000 | 50.69 | 2.50E−11 | 0 | 50.69 | 0 | 25.344 | 0 | 30.412 | 6.54 |
| 12.5 | 225 | 7166.7 | 50.69 | 4.65E−11 | 0 | 50.69 | 0 | 25.344 | 0 | 30.412 | 6.54 |
| 10 | 230 | 7333.3 | 50.69 | 8.54E−11 | 0 | 50.69 | 0 | 25.344 | 0 | 30.412 | 6.54 |
| 7.5 | 235 | 7500 | 50.69 | 1.55E−10 | 0 | 50.69 | 0 | 25.344 | 0 | 30.412 | 6.54 |
| 5 | 240 | 7666.7 | 50.69 | 2.78E−10 | 0 | 50.69 | 0 | 25.344 | 0 | 30.412 | 6.54 |
| 2.5 | 245 | 7833.3 | 50.69 | 4.94E−10 | 0 | 50.69 | 0 | 25.344 | 0 | 30.412 | 6.54 |
| 0 | 250 | 8000 | 50.69 | 8.66E−10 | 0 | 50.69 | 0 | 25.344 | 0 | 30.412 | 6.54 |

In block 550, once the cumulative TSR reactions for hydrocarbon groupings may be calculated. In block 560, the TSR index, which is the summation of the cumulative TSR of each group of hydrocarbons, may be calculated, according to equation 9. The calculated TSR index is reported below in Table 5.

TABLE 5

| Time (mybp) | Temp (° C.) | Depth (m) | Cumulative TSR_C1 (mol/ton) | Cumulative TSR_C2-C5 (mol/ton) | Cumulative TSR_C6-C14 (mol/ton) | Cumulative TSR_C15+ (mol/ton) | TSR_Index (mol/ton) |
|---|---|---|---|---|---|---|---|
| 100 | 50 | 1333.3 | 0 | 0 | 0 | 0 | 0 |
| 97.5 | 55 | 1500 | 1.25E−06 | 1.93E−07 | 6.22E−11 | 1.78E−11 | 1.44E−06 |
| 95 | 60 | 1666.7 | 4.13E−06 | 8.3E−07 | 3.13E−10 | 8.71E−11 | 4.96E−06 |
| 92.5 | 65 | 1833.3 | 1.07E−05 | 2.86E−06 | 1.28E−09 | 3.46E−10 | 1.35E−05 |
| 90 | 70 | 2000 | 2.51E−05 | 9.11E−06 | 4.9E−09 | 1.27E−09 | 3.42E−05 |
| 87.5 | 75 | 2166.7 | 5.63E−05 | 2.78E−05 | 1.78E−08 | 4.48E−09 | 8.4E−05 |
| 85 | 80 | 2333.3 | 0.000122 | 8.17E−05 | 6.25E−08 | 1.52E−08 | 0.000204 |
| 82.5 | 85 | 2500 | 0.000258 | 0.000234 | 2.12E−07 | 4.98E−08 | 0.000492 |
| 80 | 90 | 2666.7 | 0.000535 | 0.000649 | 6.93E−07 | 1.58E−07 | 0.001184 |
| 77.5 | 95 | 2833.3 | 0.001084 | 0.00176 | 2.2E−06 | 4.86E−07 | 0.002847 |
| 75 | 100 | 3000 | 0.002157 | 0.004683 | 6.77E−06 | 1.45E−06 | 0.006849 |
| 72.5 | 105 | 3166.7 | 0.004217 | 0.012359 | 2.02E−05 | 4.22E−06 | 0.0166 |
| 70 | 110 | 3333.3 | 0.008102 | 0.032894 | 5.88E−05 | 1.19E−05 | 0.041066 |
| 67.5 | 115 | 3500 | 0.015312 | 0.090038 | 0.000166 | 3.28E−05 | 0.105548 |
| 65 | 120 | 3666.7 | 0.028483 | 0.261879 | 0.000458 | 8.79E−05 | 0.290908 |
| 62.5 | 125 | 3833.3 | 0.052185 | 0.697204 | 0.001231 | 0.00023 | 0.75085 |
| 60 | 130 | 4000 | 0.094217 | 1.659202 | 0.003228 | 0.000588 | 1.757235 |
| 57.5 | 135 | 4166.7 | 0.167719 | 3.344561 | 0.008273 | 0.001469 | 3.522022 |
| 55 | 140 | 4333.3 | 0.294523 | 5.935442 | 0.020732 | 0.003593 | 6.25429 |
| 52.5 | 145 | 4500 | 0.510451 | 9.877622 | 0.050841 | 0.008605 | 10.44752 |

TABLE 5-continued

| Time (mybp) | Temp (° C.) | Depth (m) | Cumulative TSR_C1 (mol/ton) | Cumulative TSR_C2-C5 (mol/ton) | Cumulative TSR_C6-C14 (mol/ton) | Cumulative TSR_C15+ (mol/ton) | TSR_Index (mol/ton) |
|---|---|---|---|---|---|---|---|
| 50 | 150 | 4666.7 | 0.873546 | 10.34728 | 0.122105 | 0.020191 | 11.36312 |
| 47.5 | 155 | 4833.3 | 1.476742 | 13.82661 | 0.287414 | 0.046458 | 15.63722 |
| 45 | 160 | 5000 | 2.467138 | 16.13232 | 0.663506 | 0.104896 | 19.36786 |
| 42.5 | 165 | 5166.7 | 4.074982 | 17.84427 | 1.503235 | 0.232554 | 23.65504 |
| 40 | 170 | 5333.3 | 6.656828 | 19.72045 | 3.344492 | 0.506547 | 30.22832 |
| 37.5 | 175 | 5500 | 10.75912 | 22.0755 | 7.311658 | 1.084686 | 41.23097 |
| 35 | 180 | 5666.7 | 17.211 | 25.48911 | 15.71573 | 2.284651 | 60.70049 |
| 32.5 | 185 | 5833.3 | 27.25837 | 31.60549 | 33.22966 | 4.73587 | 96.82939 |
| 30 | 190 | 6000 | 42.75601 | 43.85511 | 50.68741 | 9.666449 | 146.965 |
| 27.5 | 195 | 6166.7 | 66.44018 | 57.56242 | 50.68741 | 19.43726 | 194.1273 |
| 25 | 200 | 6333.3 | 102.3124 | 63.63981 | 50.68741 | 38.52195 | 255.1616 |
| 22.5 | 205 | 6500 | 156.1749 | 75.20567 | 50.68741 | 73.68816 | 355.7562 |
| 20 | 210 | 6666.7 | 159.3119 | 96.35343 | 50.68741 | 73.68816 | 380.0409 |
| 17.5 | 215 | 6833.3 | 165.5947 | 96.35343 | 50.68741 | 73.68816 | 386.3237 |
| 15 | 220 | 7000 | 171.1063 | 96.35343 | 50.68741 | 73.68816 | 391.8353 |
| 12.5 | 225 | 7166.7 | 176.9214 | 96.35343 | 50.68741 | 73.68816 | 397.6504 |
| 10 | 230 | 7333.3 | 182.2561 | 96.35343 | 50.68741 | 73.68816 | 402.9851 |
| 7.5 | 235 | 7500 | 186.6426 | 96.35343 | 50.68741 | 73.68816 | 407.3716 |
| 5 | 240 | 7666.7 | 191.0039 | 96.35343 | 50.68741 | 73.68816 | 411.7329 |
| 2.5 | 245 | 7833.3 | 194.67 | 96.35343 | 50.68741 | 73.68816 | 415.399 |
| 0 | 250 | 8000 | 197.4511 | 96.35343 | 50.68741 | 73.68816 | 418.1801 |

The calculated TSR index is the TSR proxy value, which provides an assessment of the cumulative TSR reactions and total potential of $H_2S$ generation for a subsurface formation at a depth of interest, as $H_2S$ is a reaction product of the TSR reaction.

In the example implementation described above, the computing device 104 receives drilling parameters and calculates a TSR proxy value one or more times. In some embodiments, the computing device 104 can receive, calculate, and process the information in real-time or near real-time. By real-time, it is meant that a duration to receive successive inputs or a duration to process a received input and produce an output is less than 1 milli-second or 1 nano-second depending on the specifications of the processor 122. In some embodiments, the computing device 104 can process the information in real-time or near real-time and provide outputs of processing the information at a different frequencies. For example, the computing device 104 can provide instructions to introduce additives to the drilling fluid tank 108, for example, at regular intervals, (e.g., once every minute, once every 2 to 3 minutes, etc.) and/or at irregular intervals (e.g., when a system change has occurred). Alternatively or in addition, the computing device 104 can provide the concentrations of the additives in the wellbore drilling fluid as outputs (for example, in real-time or otherwise), for example, for display by a display device or transmission to a remote computer system 118. The outputs can provide a diagnostic of the additive losses experienced during the wellbore drilling operation, as well as instruct the wellbore drilling system 100 to take corrective action, as described above.

Accordingly, embodiments provided herein may include methods and systems for preparing wellbore drilling fluid and wellbore drilling. These embodiments may allow for the continuous, and/or repeated monitoring of a wellbore through the use of an updatable wellbore TSR proxy model. These embodiments may allow for "on the fly" wellbore drilling fluid modification during any phase of wellbore operation. Additionally, as the wellbore TSR proxy model and computing system that executes the TSR proxy model and wellbore drilling fluid modification may be integral to the drilling mechanism, at least some embodiments are configured such that the computer system is not merely a general purpose computer, but part of the overall system of drilling hardware. Additionally, the computations and/or graphical depictions could only be performed by the computing device/system described herein (or technological equivalent) and not by a human because of the complexity of computation, depiction of data, volume of data, and/or the time sensitivity of providing that data and implementing a solution would simply not be feasible for a human to perform. As such, embodiments provided herein may be configured to predict the TSR reaction progression in a wellbore and improve drilling fluid formulations to mitigate risk during drilling operations, thereby, improving the efficiency of oil production.

According to an aspect, either alone or in combination with any other aspect, a wellbore drilling system comprising a drilling fluid tank that holds wellbore drilling fluid for introduction into a wellbore, an additive distribution component fluidly coupled to the drilling fluid tank that holds a first additive, and a computing device communicatively coupled to the additive distribution component. The computing device including a processor and a memory component, the memory component storing logic that, when executed by the processor, causes the wellbore drilling system to perform at least the following: receive drilling parameters identifying wellbore drilling conditions of the wellbore drilling system; calculate a thermochemical sulfate reduction (TSR) proxy value of the wellbore, wherein the TSR proxy value predicts progression of a TSR reaction in the wellbore, and wherein the TSR proxy value predicts a hydrogen sulfide concentration in the wellbore; and determine whether the predicted hydrogen sulfide concentration meets a first threshold. In response to determining that the predicted hydrogen sulfide concentration meets the first threshold, the wellbore drilling system performs at least the following: determine a first quantity of the first additive to be added to the drilling fluid tank to increase a concentration of the first additive in the wellbore drilling fluid, and send an instruction to the additive distribution component to release the first quantity of the first additive to the drilling fluid tank.

According to a second aspect, either alone or in combination with any other aspect, wherein the additive distribution component comprises a hydrogen sulfide scavenger reservoir that holds the first additive.

According to a third aspect, either alone or in combination with any other aspect, wherein the first additive is a hydrogen sulfide scavenger compound.

According to a fourth aspect, either alone or in combination with any other aspect, wherein the hydrogen sulfide scavenger compound comprises inorganic peroxides, aldehydes, dialdehydes, trizaines, hydantoins, irons salts, or combinations thereof.

According to a fifth aspect, either alone or in combination with any other aspect, wherein the additive distribution component further comprises a second additive; and wherein the computing device causes the wellbore drilling system to further perform at least the following: determine a corrosion parameter, based on the predicted hydrogen sulfide concentration in the wellbore; determine whether the corrosion parameter meets a second threshold; in response to determining that the corrosion parameter meets the second threshold: determine a second quantity of the second additive to be added to the drilling fluid tank to increase a concentration of the second additive in the wellbore drilling fluid; and send an instruction to the additive distribution component to release the second quantity of the second additive to the drilling fluid tank.

According to a sixth aspect, either alone or in combination with any other aspect, wherein the additive distribution component comprises a corrosion inhibitor reservoir that holds the second additive, exclusive of the first additive.

According to a seventh aspect, either alone or in combination with any other aspect, wherein the second additive is a corrosion inhibitor compound.

According to an eighth aspect, either alone or in combination with any other aspect, wherein the second additive is a corrosion inhibitor compound comprising amidoamines, quaternary amines, amides, phosphate esters, or combinations thereof.

According to a ninth aspect, either alone or in combination with any other aspect, wherein the additive distribution component comprises hydrogen sulfide scavenger compounds, corrosion inhibitor compounds, biocides, chlorinating agents, or a combination of two or more thereof.

According to a tenth aspect, either alone or in combination with any other aspect, wherein the drilling parameters include a rate of penetration of a drill bit, a flow rate of the wellbore drilling fluid through the wellbore, and a depth in the subsurface formation where the wellbore is being drilled.

According to an eleventh aspect, either alone or in combination with any other aspect, further comprising a hydrogen sulfide sensor that measures a concentration of hydrogen sulfide in the wellbore, and the computing device modifies the TSR proxy value based on the measured concentration of hydrogen sulfide in the wellbore.

According to a twelfth aspect, either alone or in combination with any other aspect, further comprising a wellbore pump that pumps the wellbore drilling fluid from the drilling fluid tank to a wellbore drilling rig, and the computing device sends instructions to the wellbore pump to modify a flow rate of the wellbore drilling fluid.

According to a thirteenth aspect, either alone or in combination with any other aspect, a method of preparing wellbore drilling fluid, the method comprising a computing device performing at least the following: receiving drilling parameters that identify wellbore drilling conditions of a wellbore drilling system; calculating a thermochemical sulfate reduction (TSR) proxy value of the wellbore, where the TSR proxy value predicts the progression of a TSR reaction in a wellbore, and the TSR proxy value predicts a hydrogen sulfide concentration in the wellbore; in response to determining that the predicted hydrogen sulfide concentration meets a predetermined threshold: determining a first quantity of a first additive to be added to the wellbore drilling fluid; and combining the first quantity of the first additive with the wellbore drilling fluid.

According to a fourteenth aspect, either alone or in combination with any other aspect, wherein the first additive is a hydrogen sulfide scavenger compound.

According to a fifteenth aspect, either alone or in combination with any other aspect, wherein the first additive comprises inorganic peroxides, aldehydes, dialdehydes, trizaines, hydantoins, or combinations thereof.

According to a sixteenth aspect, either alone or in combination with any other aspect, further comprising: determining a corrosion parameter, based on the predicted hydrogen sulfide concentration in the wellbore; in response to determining that the corrosion parameter meets a second threshold: determining a second quantity of a second additive to be added to the wellbore drilling fluid; and combining the second quantity of the second additive with the wellbore drilling fluid.

According to a seventeenth aspect, either alone or in combination with any other aspect, wherein the second additive is a corrosion inhibitor compound.

According to an eighteenth aspect, either alone or in combination with any other aspect, further comprising: receiving a measured hydrogen sulfide concentration in the wellbore; and modifying the TSR proxy value based on the measured hydrogen sulfide concentration.

According to a nineteenth aspect, either alone or in combination with any other aspect, further comprising monitoring a concentration of the first additive in the wellbore drilling fluid.

According to a twentieth aspect, either alone or in combination with any other aspect, further comprising transmitting at least one of the following to a display device: a measured hydrogen sulfide concentration, a calculated hydrogen sulfide concentration, or a concentration of the first additive in the wellbore drilling fluid.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that recitations herein of "at least one" component, element, etc., should not be used to create an inference that the alternative use of the articles "a" or "an" should be limited to a single component, element, etc.

It is also noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising.

The invention claimed is:

1. A wellbore drilling system comprising:

a drilling fluid tank that holds wellbore drilling fluid for introduction into a wellbore;

an additive distribution component comprising a first valve, wherein the additive distribution component is fluidly coupled to the drilling fluid tank that holds a first additive;

a computing device communicatively coupled to the additive distribution component, the computing device including a processor and a memory component, the memory component storing logic that, when executed by the processor, causes the wellbore drilling system to perform at least the following:

receive drilling parameters identifying wellbore drilling conditions of the wellbore drilling system, wherein the drilling parameters include a rate of penetration of a drill bit, a flow rate of the wellbore drilling fluid through the wellbore, and a depth in the subsurface formation where the wellbore is being drilled;

calculate a thermochemical sulfate reduction (TSR) proxy value of the wellbore, wherein the TSR proxy value predicts progression of a TSR reaction in the wellbore, and wherein the TSR proxy value predicts a hydrogen sulfide concentration in the wellbore;

determine whether the predicted hydrogen sulfide concentration meets a first threshold;

in response to determining that the predicted hydrogen sulfide concentration meets the first threshold:

determine a first quantity of the first additive to be added to the drilling fluid tank to increase a concentration of the first additive in the wellbore drilling fluid; and send an instruction to the additive distribution component to actuate the first valve to release the first quantity of the first additive to the drilling fluid tank; and a hydrogen sulfide sensor that measures a concentration of hydrogen sulfide in the wellbore, wherein the computing device modifies the TSR proxy value based on the measured concentration of hydrogen sulfide in the wellbore.

2. The system of claim 1, wherein the additive distribution component comprises a hydrogen sulfide scavenger reservoir that holds the first additive.

3. The system of claim 1, wherein the first additive is a hydrogen sulfide scavenger compound.

4. The system of claim 3, wherein the hydrogen sulfide scavenger compound comprises inorganic peroxides, aldehydes, dialdehydes, triazines, hydantoins, irons salts, or combinations thereof.

5. The system of claim 1, wherein the additive distribution component further comprises a second additive and a second valve; and wherein the computing device causes the wellbore drilling system to further perform at least the following:

determine a corrosion parameter, based on the predicted hydrogen sulfide concentration in the wellbore;

determine whether the corrosion parameter meets a second threshold;

in response to determining that the corrosion parameter meets the second threshold:

determine a second quantity of the second additive to be added to the drilling fluid tank to increase a concentration of the second additive in the wellbore drilling fluid; and send an instruction to the additive distribution component to actuate the second valve to release the second quantity of the second additive to the drilling fluid tank.

6. The system of claim 5, wherein the additive distribution component comprises a corrosion inhibitor reservoir that holds the second additive, exclusive of the first additive.

7. The system of claim 5, wherein the second additive is a corrosion inhibitor compound.

8. The system of claim 5, wherein the second additive is a corrosion inhibitor compound comprising amidoamines, quaternary amines, amides, phosphate esters, or combinations thereof.

9. The system of claim 1, wherein the additive distribution component comprises hydrogen sulfide scavenger compounds, corrosion inhibitor compounds, biocides, chlorinating agents, or a combination of two or more thereof.

10. The system of claim 1, further comprising a wellbore pump that pumps the wellbore drilling fluid from the drilling fluid tank to a wellbore drilling rig, and the computing device sends instructions to the wellbore pump to modify a flow rate of the wellbore drilling fluid.

11. A method of preparing wellbore drilling fluid, the method comprising a computing device performing at least the following:

receiving drilling parameters that identify wellbore drilling conditions of a wellbore drilling system, wherein the drilling parameters include a rate of penetration of a drill bit, a flow rate of the wellbore drilling fluid through the wellbore, and a depth in the subsurface formation where the wellbore is being drilled, and wherein the wellbore drilling system comprises:

a drilling fluid tank comprising the wellbore drilling fluid;

an additive distribution component comprising a first valve; and the computing device;

calculating a thermochemical sulfate reduction (TSR) proxy value of the wellbore, where the TSR proxy value predicts the progression of a TSR reaction in a wellbore, and the TSR proxy value predicts a hydrogen sulfide concentration in the wellbore;

in response to determining that the predicted hydrogen sulfide concentration meets a predetermined threshold:

determining a first quantity of a first additive to be added to the wellbore drilling fluid;

actuating the first valve for a duration sufficient to release the first quantity of the first additive; and combining the first quantity of the first additive with the wellbore drilling fluid.

12. The method of claim 11, wherein the first additive is a hydrogen sulfide scavenger compound.

13. The method of claim 11, wherein the first additive comprises inorganic peroxides, aldehydes, dialdehydes, triazines, hydantoins, or combinations thereof.

14. The method of claim 11, further comprising:

determining a corrosion parameter, based on the predicted hydrogen sulfide concentration in the wellbore;

in response to determining that the corrosion parameter meets a second threshold:

determining a second quantity of a second additive to be added to the wellbore drilling fluid; and combining the second quantity of the second additive with the wellbore drilling fluid.

15. The method of claim 14, wherein the second additive is a corrosion inhibitor compound.

16. The method of claim 11, further comprising:

receiving a measured hydrogen sulfide concentration in the wellbore; and modifying the TSR proxy value based on the measured hydrogen sulfide concentration.

17. The method of claim 11, further comprising monitoring a concentration of the first additive in the wellbore drilling fluid.

18. The method of claim 11, further comprising transmitting at least one of the following to a display device: a measured hydrogen sulfide concentration, a calculated hydrogen sulfide concentration, or a concentration of the first additive in the wellbore drilling fluid.

19. A wellbore drilling system comprising:

a drilling fluid tank that holds wellbore drilling fluid for introduction into a wellbore;

an additive distribution component comprising a first valve, wherein the additive distribution component is fluidly coupled to the drilling fluid tank that holds a first additive;

a computing device communicatively coupled to the additive distribution component, the computing device including a processor and a memory component, the memory component storing logic that, when executed by the processor, causes the wellbore drilling system to perform at least the following:

receive drilling parameters identifying wellbore drilling conditions of the wellbore drilling system;

calculate a thermochemical sulfate reduction (TSR) proxy value of the wellbore, wherein the TSR proxy value predicts progression of a TSR reaction in the wellbore, and wherein the TSR proxy value predicts a hydrogen sulfide concentration in the wellbore;

determine whether the predicted hydrogen sulfide concentration meets a first threshold;

in response to determining that the predicted hydrogen sulfide concentration meets the first threshold:

determine a first quantity of the first additive to be added to the drilling fluid tank to increase a concentration of the first additive in the wellbore drilling fluid; and send an instruction to the additive distribution component to actuate the first valve to release the first quantity of the first additive to the drilling fluid tank; and a hydrogen sulfide sensor that measures a concentration of hydrogen sulfide in the wellbore, wherein the computing device modifies the TSR proxy value based on the measured concentration of hydrogen sulfide in the wellbore; and a wellbore pump that pumps the wellbore drilling fluid from the drilling fluid tank to a wellbore drilling rig, and the computing device sends instructions to the wellbore pump to modify a flow rate of the wellbore drilling fluid.

* * * * *